US005924063A

United States Patent [19]

Funaki et al.

[11] Patent Number: 5,924,063

[45] Date of Patent: Jul. 13, 1999

[54] CELP-TYPE SPEECH ENCODER HAVING AN IMPROVED LONG-TERM PREDICTOR

[75] Inventors: Keiichi Funaki; Kazunori Ozawa, both of Tokyo, Japan

[73] Assignee: NEC Corporation, Tokyo, Japan

[21] Appl. No.: 08/578,910

[22] Filed: Dec. 27, 1995

Related U.S. Application Data

[30] Foreign Application Priority Data

Dec. 27, 1994 [JP] Japan ..... 6-323454

[51] Int. Cl.[6] ..... G10L 3/02; G10L 9/00

[52] U.S. Cl. ..... 704/223; 704/220; 704/219; 704/207

[58] Field of Search ..... 395/2.16, 2.1, 395/2.31, 2.32; 704/223, 220, 219, 207

[56] References Cited

U.S. PATENT DOCUMENTS

| | | | |
|---|---|---|---|
| 5,233,660 | 8/1993 | Chen | 395/2.16 |
| 5,359,696 | 10/1994 | Gerson et al. | 395/2.32 |

FOREIGN PATENT DOCUMENTS

| | | | |
|---|---|---|---|
| 0 409 239 A2 | 1/1991 | European Pat. Off. | 395/2.16 |
| 0501421 | 9/1992 | European Pat. Off. . | |

OTHER PUBLICATIONS

Low–Delay Vector Excitation Coding of Speech at 8 kbit/s, by Jy–Hsin Yao et al.; Globecom '91.

Interpolation of the Pitch–Predictor Parameters in Analysis–by–Synthesis Speech Coders, by Kleijn, et al., IEEE Transactions on Speech and Audio Processing, Jan. 2, 1994, Part 1.

Efficient Techniques for Determining And Encoding the Long Term Predictor Lags for Analysis–by–Synthesis Speech Coders, by Gerson et al., Corporate Systems Research Laboratories, Motorola.

Ahmed, M E et al, Fast Code Search in CELP IEEE, Trans Spch and Audio, vol. 1, No. 3, pp. 315–325, Jul. 1993.

P. Kroon et al., "Pitch Predictors with high Temporal Resolution", *IEEE* 1990, CH2847–2/90/0000–0661, pp. 661–664.

I.A. Gerson et al., "Techniques for Improving the Performance of CELP–Type Speech Coders", *IEEE Journal on Selected Areas in Communications*, vol. 10, No. 5, Jun. 1992, pp. 858–865.

M. R. Schroeder et al., "Code–Excited Linear Prediction (CELP): High–Quality Speech at very Low bit Rates", *IEEE* 1985, Ch2118–8/85/0000–0937, pp. 937–940.

*Primary Examiner*—David R. Hudspeth
*Assistant Examiner*—Robert Louis Sax
*Attorney, Agent, or Firm*—Sughrue, Mion, Zinn, Macpeak & Seas, PLLC

[57] ABSTRACT

A speech signal encoder includes a speech analyzer for determining short-term prediction codes at a predetermined time interval. The prediction codes indicate frequency characteristics of a speech signal. A reverse filter is provided for calculating residual signals of first synthesis filter. The residual signals are defined by the short-term prediction codes. A residual code book stores past residual signals. Further, a plurality of delay codes, each of which represents pitch correlation of the speech signal, are predetermined. A vector generator issues, using the residual code book, delay residual vectors each of which corresponds to the delay code. A filter is provided for generating a synthesis signal using second synthesis filter which receives the delay residual vectors and which is defined by the short-term prediction codes. A distance between the speech signal and the synthesis signal is calculated. Subsequently, a pitch path estimator estimates a pitch path which varies smoothly. The pitch path thus estimated is used for determining a delay code.

15 Claims, 12 Drawing Sheets

CELP-TYPE SPEECH ENCODER HAVING AN IMPROVED LONG-TERM PREDICTOR

BACKGROUND OF THE INVENTION

1. Field of the Invention

The present invention relates generally to a speech signal encoder and more specifically to a speech signal encoder utilizing a CELP (code-excited linear predictive) coding scheme which has been found well suited for encoding a speech signal at a low bit rate ranging from 4 Kb/s to 8 Kb/s (for example) without deteriorating human auditory perception.

2. Description of the Related Art

Digital technology is rapidly introduced in recent years into a mobile or cordless radio telephone system. However, frequency spectrum available to a radio communications system is strictly limited and thus, it is vital to encode a speech signal at a bit rate as low as possible.

By way of example, a CELP coding technique for encoding a speech signal at a low bit rate ranging from 4 kb/s (kilo-bit per second) to 8 kb/s is disclosed in a paper entitled "Code-Excited Linear Prediction (CELP)C High-Quality Speech at Very Low Bit Rates" by M. R. Schroeder, et al., CH2118-8/85/0000-0937 $1.00, 1985 IEEE, pages 937–940 (referred to as Paper 1).

According to Paper 1, a speech signal is first partitioned into a plurality of frames (one frame=20 ms (for example)) and, a short-term prediction code indicating frequency characteristics is extracted from each frame. Subsequently, each frame is further divided into a plurality of subframes.

An optimal delay code is determined from each subframe using previously prepared delay codes and an adaptive code book. The above mentioned delay code indicates speech pitch correlation, while the adaptive code book stores past excitation signals. In more specific terms, the delay code is subjected to a predetermined amount of "testing", after which the past excitation signal is retarded by a delay corresponding to each delay code. Thus, an optimal code vector is extracted. The extracted optimal code vector is used to produce a synthesis signal which is in turn employed to calculate an error electric power (viz., distance) relative to the speech signal. Subsequently, an optimal delay code with the minimum distance is determined. Further, an adaptive code vector and its gain, both corresponding to the optimal delay code, are determined.

Following this, a synthesis signal is produced using excitation code vectors extracted from an excitation code book which previously stores a plurality of quantized codes (viz., noise signals). Thereafter, an excitation code vector and their gain thereof are determined whose distance exhibits the minimal value between the synthesis signal and the residual sinal which is obtained by long-term prediction.

Finally, the following indices are transmitted to a receiver. That is, one index represents both the adaptive code vector and the kind of the excitation code vector, while the other index demonstrates the gain of each excitation signal and the kind of spectral parameters.

Let us discuss in more detail how to search for the delay code of an adaptive code vector. An incoming speech signal x[n] is weighted in terms of auditory perception and is subtracted from a past affecting signal. The resulting signal is denoted by z[n]. Thereafter, a synthesis signal $He_d[n]$ is calculated by allowing an adaptive code vector $e_d[n]$, corresponding to a delay code d, to drive a synthesis filter H. The synthesis filter H is constructed by spectral parameters which are determined using the short-term prediction, quantized and inverse quantized. Following this, the delay code d is determined which minimizes the following equation (1) indicating an error electric power (viz., distance) between z[n] and $He_d[n]$.

$$Ed=\Sigma(z[n]-g_d\cdot H\cdot e_d[n])^2 \quad (1)$$

where Σ denotes a total sum of n from 0 to (Ns−1), Ns denotes a subframe's length, H denotes a matrix for realizing the synthesis filter, $g_d$ indicates the gain of the adaptive code vector $e_d$. Throughout the instant disclosure, Σ denotes a total sum of n from 0 to (Ns−1).

Equation (1) can be rewritten as given below.

$$Ed=\Sigma\ z[n]^2-Cd^2/Gd \quad (2)$$

where Cd indicates correlation, and Gd indicates auto-cross-correlation. Cd and Gd are given by $$Cd=\Sigma z[n]\cdot H\cdot e_d[n] \quad (3)$$

$$Gd=\Sigma(H\cdot e_d[n])^2 \quad (4)$$

The expression $e_d[n]$ indicates a vector corresponding to the excitation signal which has been determined by encoding the foregoing frames and which has been delayed by the amount of the delay code d. The above mentioned long-term predicting method for determining an optimal delay code using filtering is called an adaptive code book search using a closed loop processing.

With the CELP encoding, the auditory quality depends on the accuracy of the long-term prediction. One known approach to improving the accuracy of the long-term prediction is a decimal (radix) point delay for expanding a delay code from integer point to radix point. Such prior art is disclosed in a paper entitled "Pitch Predictors with High Temporal Resolution" by Peter Kroon, et al., CH2847-2/90/0000-0661, 1990 IEEE (referred to as Paper 2).

The decimal point delay is able to increase sound quality. However, this approach carries out the optimization within each subframe per se and thus, it is difficult to effectively comply with the changes of delayed values extending over a plurality of subframes (viz., pitch path). In other words, the pitch path is not sufficiently smoothed and occasionally induces occurrence of large gaps. It is known that gaps in a pitch path causes discontinuity or wave fluctuation in an encoded speech signal, which leads to degradation of speech quality.

In order to address the just mentioned problems, the following method has been proposed. A candidate of a delay code is determined with respect to each subframe using an open-loop processing for matching the speech signal itself. Subsequently, a pitch path is determined such that the delay value (viz., pitch) becomes smooth over the entirg frame. This known technique is disclosed in a paper entitled "Techniques for Improving the Performance of CELP-Type Speech Coders" by Ira A. Gerson, et al., IEEE Journal on Selected Areas in Communications, Vol. 10, No. 5, June 1992, pages 858–865 (referred to as Paper 3).

Paper 3 discloses processes for smoothing a pitch path using distances or correlations determined at each subframe. More specifically, all the subframes of each frame are sequentially subjected to the following steps (a)–(d) and finally a pitch path which changes smoothly is determined at step (e):

(a) A delay code of a first subframe is evaluated;

(b) In connection with the evaluated delay code, a delay speech vector $x^d$ is produced by referring to an open-loop adaptive code-book which has stored previous speech signals or codes weighted with auditory perception;

(c) A cross-correlation value $<x, x^d>$ and auto-correlation value $<x^d, x^d>$ are calculated using an auditory perception weighted signal or a speech signal of the coded subframe;

(d) Using the calculated correlation values, a distance $E=<x, x^d>^2/<x^8, x^d>$ is produced which represents an error energy between the speech signal and the delayed speech vector;

(e) After all the subframes of one frame are processed using steps (a)–(d), a pitch path are smoothed using distances or correlations determined in terms of each subframe; and (f) Using the pitch path obtained step (e), an optimal delay code of each subframe is determined by way of a conventional closed-loop code-book search.

Thus, the delay value (pitch), represented by estimated delay codes, varies smoothly and results in good speech quality.

The open-loop search disclosed in Paper 3 is to search for an optimal delay code by matching previous and current speech signal vectors. However, in the case where a pitch difference is extracted from the previous and current speech signal vectors as disclosed in Paper 3, such technique suffers from the problem that a large estimation error tends to occur. This is because the above mentioned two vectors have different spectral components with each other.

On the other hand, the closed-loop adaptive codebook search, such as disclosed in Paper 1 or 2, is able to more correctly estimate delay codes. However, this prior art has encountered the difficulty that the pitch path is not estimated in that the previous excitation signals (viz., encoding results of the previous subframes) are inevitably required.

What is desired is to provide an improved technique wherein a pitch path which varies smooth can be estimated in long-term prediction in order to achieve good speech quality at low bit rates.

SUMMARY OF THE INVENTION

It is an object of the present invention to provide a CELP-type speech signal encoder via which a smoothly varying pitch path is effectively estimated in long-term prediction.

These objects are fulfilled by a technique wherein a speech signal encoder includes a speech analyzer for determining short-term prediction codes at a predetermined time interval. The prediction codes indicate frequency characteristics of a speech signal. A reverse filter is provided for calculating residual signals of first synthesis filter. The residual signals are defined by the short-term prediction codes. A residual code book stores past residual signals. Further, a plurality of delay codes which are predetermined numbers, each of which represents pitch correlation of the speech signal. A vector generator issues, using the residual code book, delay residual vectors each of which corresponds to the delay code. A filter is provided for generating a synthesis signal using second synthesis filter which receives the delay residual vectors and which is defined by the short-term prediction codes. A distance between the speech signal and the synthesis signal is calculated. subsequently, a pitch path estimator estimates a pitch path which varies smoothly. The pitch path thus estimated is used for determining a delay code.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

Before turning to the preferred embodiments of the present invention, the principles underlying the invention are described.

According to the present invention, estimating a pitch path at a long-term predictor utilizes distances or correlation values determined by the following equation (5). In more specific terms, the distances or correlation values are calculated using closed-loop processing wherein delay residual vectors are filtered by a synthesis filter which is defined by short-term prediction codes. The delay residual vectors are determined by retarding past (previous) residual signals.

$$\begin{aligned} Ed &= \sum (x[n] - g \cdot Hr_d[n])^2 \\ &= \sum (Hr[n] - g \cdot Hr_d[n])^2 \\ &= \langle x, x\rangle - \langle x, Hr^d\rangle^2 / \langle Hr^d, Hr^d\rangle \end{aligned} \tag{5}$$

$$r^d[n] = r[n - di] \tag{6}$$

where r[n]: a residual signal of the current frame;

$r^d[n]$: a vector of a delay residual signal which is obtained by retarding r[n] by d;

H: the synthesis filter;

g: a gain; and di: a delayed value corresponding to the delay code d.

Equation (5) is rewritten in terms of vector.

$$\begin{aligned} E &= (Hr - g \cdot Hr_d)^T \cdot (Hr - g \cdot Hr^d) \\ &= (r - g \cdot r^d)^T \cdot H^T H \cdot (r - g \cdot r^d) \end{aligned} \tag{7}$$

It is understood that the spectral component ($H^TH$) is independent of each of delays d in a delay trial procedure which is described later, Further, the term ($r-g \cdot r^d$) of equation (7) is a difference between pitch weighted components which are less affected by spectrum. Thus, a more precise match can be realized compared with the matching between speech and delayed speech vectors in the conventional open-loop processing. Accordingly, a pitch path can be estimated with less occurrences of errors than the conventional open-loop pitch path estimation.

Still further, as shown in equation (5), the residual signals are used in determining the distance E and as such, the estimation of the pitch path over a plurality of subframes can be realized.

The above mentioned synthesis filter H may include an IIR (infinite impulse response) and FIR (finite impulse response) filters. The FIR filter is utilized in third and fourth embodiments of the present invention.

First Embodiment

Figure 1:
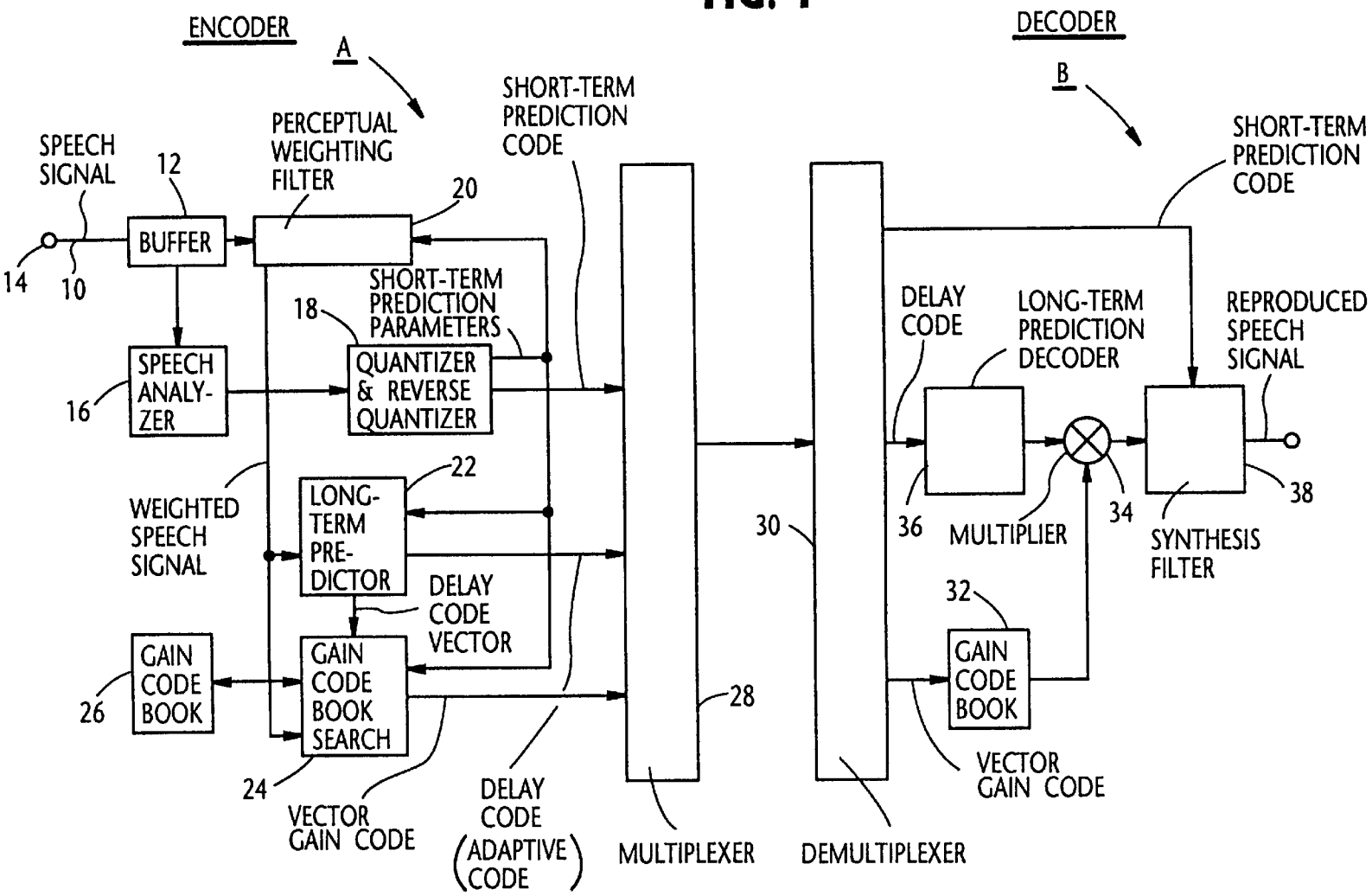
FIG. 1 is a block diagram showing a first, third, and fifth embodiment of the present invention.

Reference is now made to FIG. 1, wherein the first embodiment of the present invention is illustrated in block diagram form. The present invention resides in improvements of a long-term predictor and hence other functional blocks in the drawing are briefly described.

The arrangement of FIG. 1 is generally comprised of an encoder and decoder respectively depicted by A and B.

A speech signal 10 which has been sampled at a low bit rate is applied to a buffer 12 via an input terminal 14. The speech signal stored in the buffer 12 is applied to a speech analyzer 16 which implements a short-term prediction analysis on the speech signal and produces short-term prediction parameters (viz., LPC (linear predictive coding) coefficients) which exhibit spectrum characteristics of the speech signal. The short-term prediction parameters are then quantized and also reverse quantized at a block 18. The quantized and reverse quantized parameters are applied to a perceptual weighting filter 20, a long-term predictor 22, and a gain code book searcher 24. The filter 20 weights the speech signal from the buffer 12 with human auditory perception, and applies the weighted speech signal (vector) to the long-term predictor 22 and the gain code book searcher 24.

The long-term predictor 22, to which the present invention is applied, receives the short-term prediction parameters and the weighted speech signal and then generates adaptive code vectors and delay codes (viz., adaptive codes), as illustrated in FIG. 1. The delay codes are sent to a multiplexer 28, while the delay code vectors are applied to the gain code book searcher 24. The long-term predictor 22 will be discussed in more detail with reference to FIGS. 2A, 2B and 2C.

The gain code book searcher 24, using the adaptive code vectors and the weighted speech signal, determines a vector gain of each delay code by referring to a gain code book 26 which has previously stored parameters indicating vector gains of the corresponding delay codes. The codes representing gains of the delay codes are forwarded to the multiplexer 28.

The above mentioned three codes, outputted from the blocks 18, 22 and 24, are combined by a multiplier 28 and transmitted to the decoder B.

The decoder D is a conventional one and thus, brief description thereof are given. A demultiplexer 30 outputs short-term prediction codes, the delay codes, and the codes indicating the gains of the corresponding delay codes. A gain code book 32 is provided to produce the gains of the delay code vectors based on the vector gain codes applied thereto, The vector gains thus generated are fed to a multiplier 34. On the other hand, a longterm prediction decoder 36 receives the delay codes and reproduces the corresponding delay code vectors which are applied to the multiplier 34. The multiplier 34 multiplies the two inputs and generates an excitation signal which is applied to a synthesis filter 38. This filter 38 initially decodes the short-term prediction codes applied thereto from the demultiplexer 30. Thereafter, the synthesis filter 38, using the decoded short-term predictor codes and the excitation signal, reproduces an original speech signal.

Figure 2A:
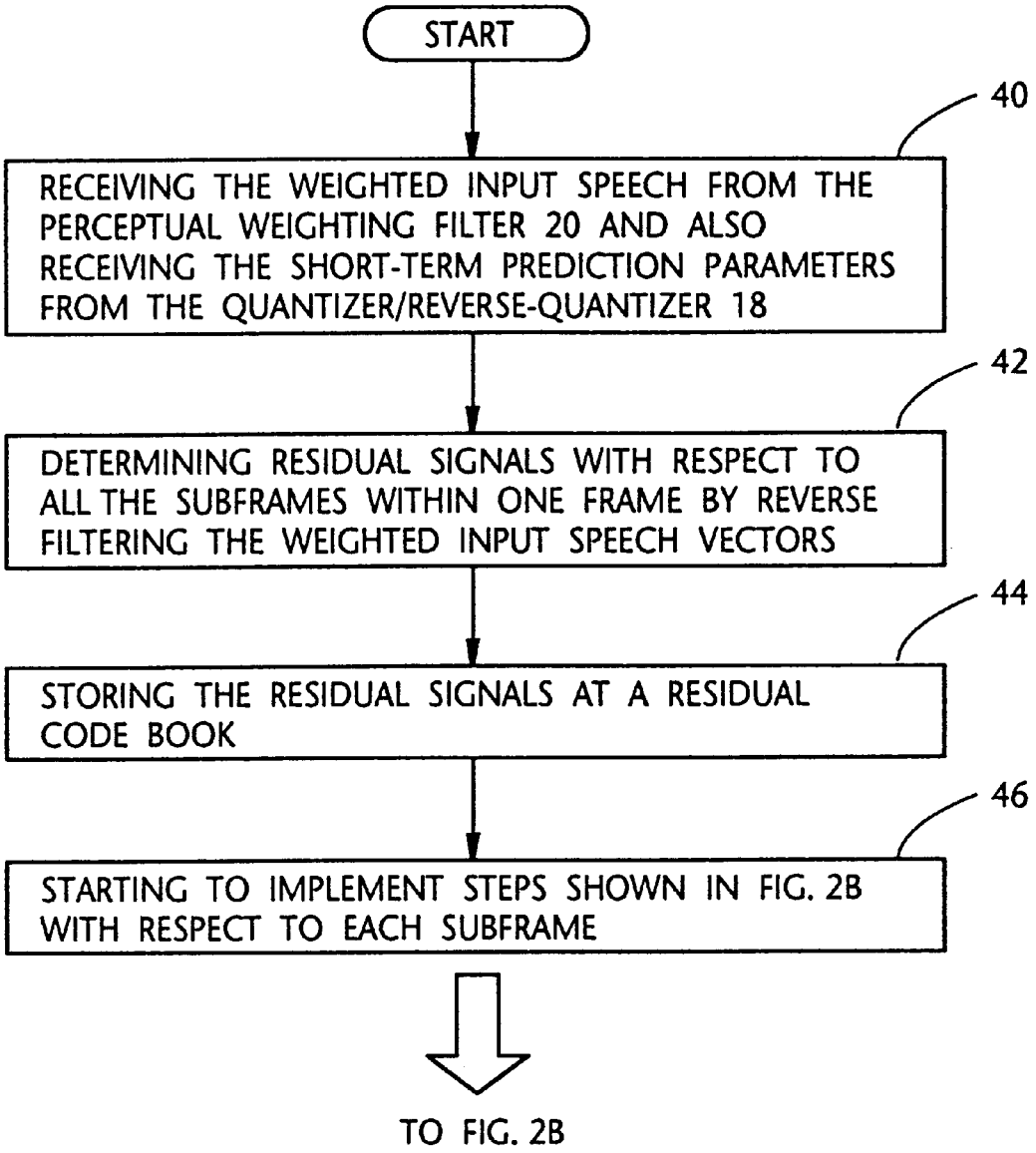
FIGS. 2A–2C are flow charts which characterize the operations of a long-term predictor of FIG. 1 which is relevant to the first embodiment.
Figure 2B:
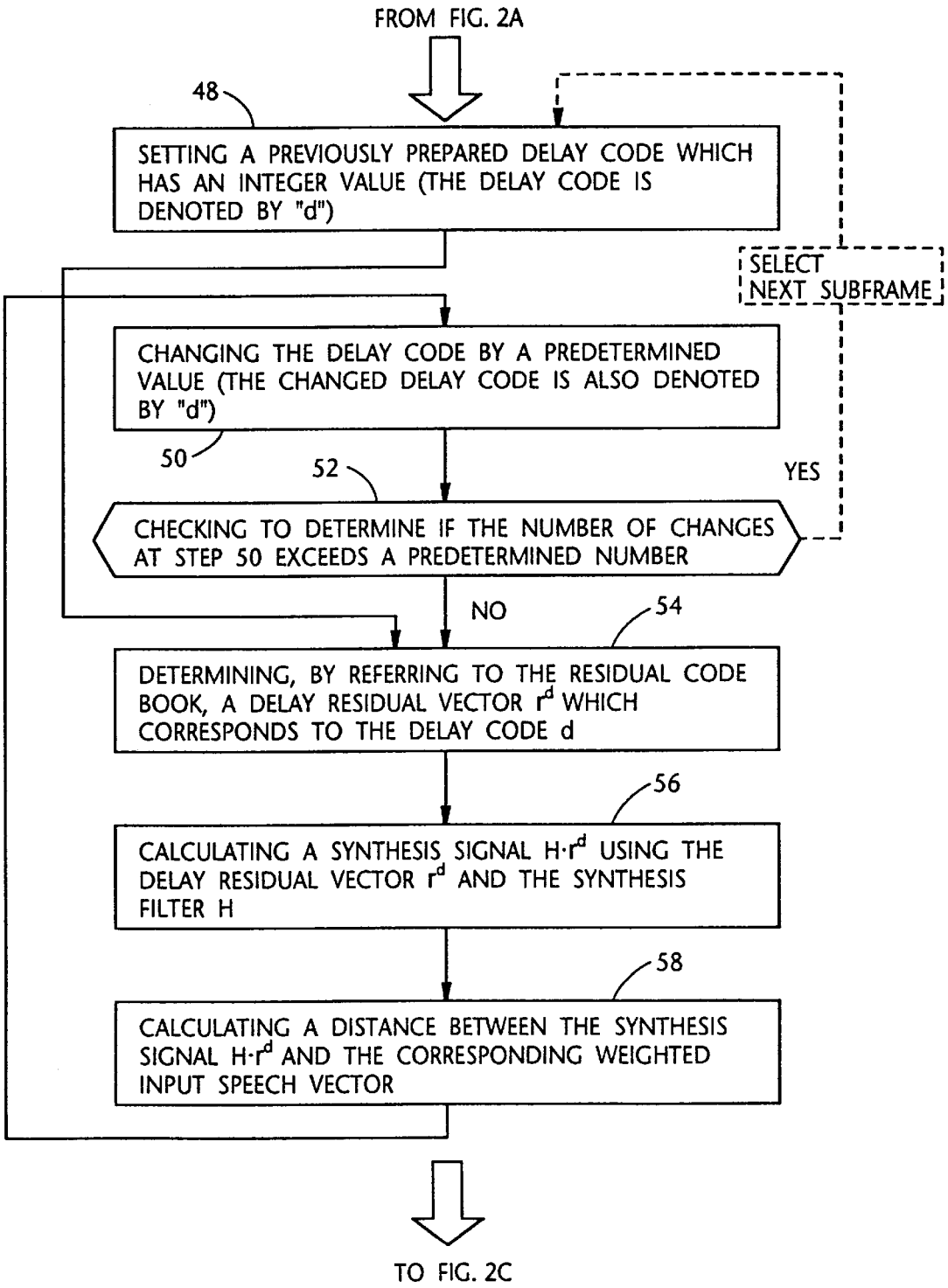
Figure 2C:
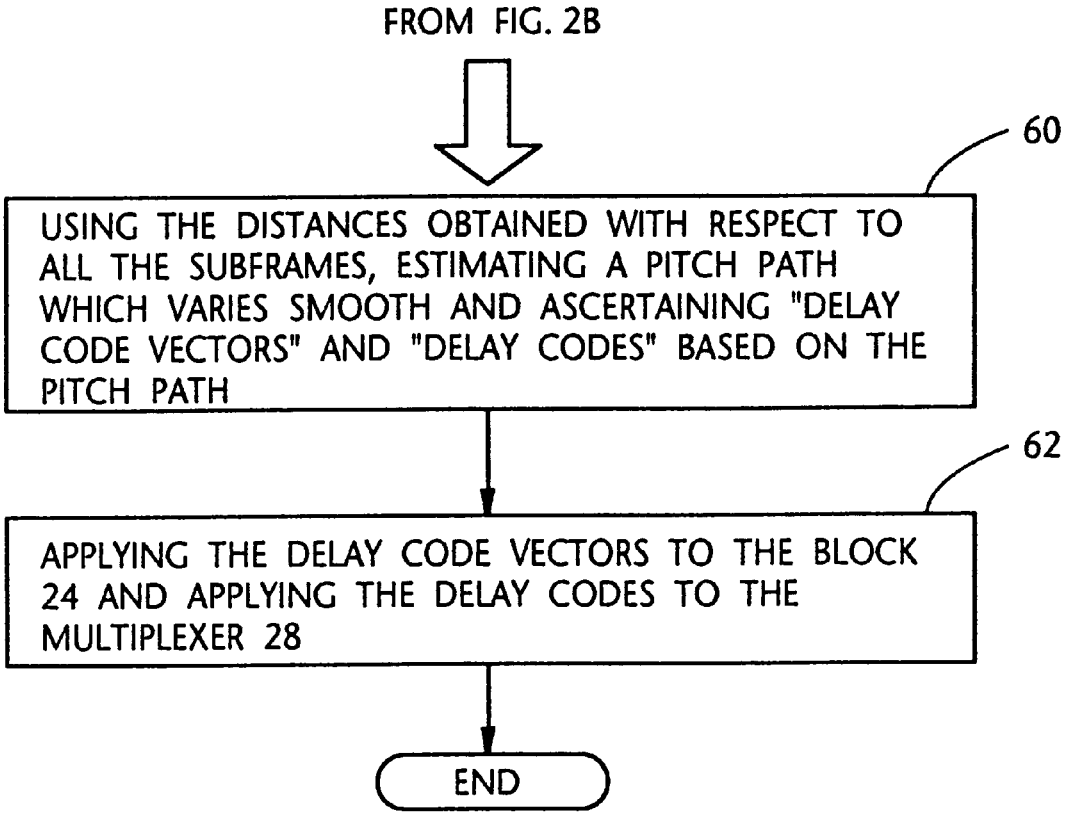

Reference is made to FIGS. 2A, 2B and 2C, wherein there are shown flow charts each of which includes functional steps which characterize the operations of the long-term predictor 22 of FIG. 1.

In FIG. 2A, at step 40 the long-term predictor 22 receives the weighted speech signal from the weighting filter 20 and also receives the short-term prediction parameters from the quantizer/reverse-quantizer 18.

Following this, at step 42, the predictor 22 determines residual signals with respect to all the subframes within one frame by reverse filtering the weighted speech signals (vectors). In more specific terms, the reverse filter is defined by the short-term prediction parameters. At step 44, the residual signals obtained in step 42 are stored in a residual code book (not shown). Subsequently, the long-term predictor 22 starts to implement a plurality of steps shown in FIG. 2B.

In FIG. 2B, at step 48, a delay trial procedure is prepared by setting a previously stored delay code having an integer value (the delay code is denoted by "d"). The delay trial which is implemented at steps of FIG. 2B, is to provide a plurality of distances for a later procedure for pitch path estimation. The delay trial per se is a conventional technique but includes improved techniques according to the present invention.

The routine goes to step 54 in that this is the first loop. At step 54, a delay residual vector $r^d$ in determined by referring to the residual code book described at step 44 of FIG. 2A. The delay residual vector $r^d$ is determined using equation (6) and corresponds to the delay code d. Following this, at step 56, a synthesis signal $H \cdot r^d$ is calculated using the delay residual vector $r^d$ and the synthesis filter H which is defined by the short-term prediction parameters. At the next step 58, a distance or correlation between the synthesis signal $H \cdot r^d$ and the corresponding weighted input vector is calculated. The distance is a square error of the synthesis signal $H \cdot r^d$ and the weighted input speech vector, a cross-correlation value $<x, H \cdot r^d>$, or an auto-correlation value $<H \cdot r^d, H \cdot r^d>$ Thereafter, the routine goes to step 50 whereat the integer value of the delay code is changed by a predetermined value (the changed delay code is also depicted by "d"). Subsequently, a check is made at step 52 to determine if the number of changes of the delay code's value exceeds a predetermined number. If the answer is no, the routing goes to step 54 for implementing the above mentioned operations. Otherwise (viz., the answer is negative), the routine goes back to step 48 for carrying out the next subroutine.

When all the subframes within one frame are processed according to steps of FIG. 2B, steps shown in FIG. 2C are executed.

In FIG. 2C, at step 60, using the distances obtained with respect to all the subframes, pitch path is determined which varies smooth. Thereafter, the delay codes and the corresponding delay code vectors are ascertained based on the smoothly varying pitch path. The smooth pitch path estimation per se is known in the art and can be done using Papers 1 and 2 by way of example. Subsequently, at step 62, the delay code vectors are applied to the block 24 (FIG. 1), while the delay codes are applied to the multiplexer 28.

Second Embodiment

Figure 3:
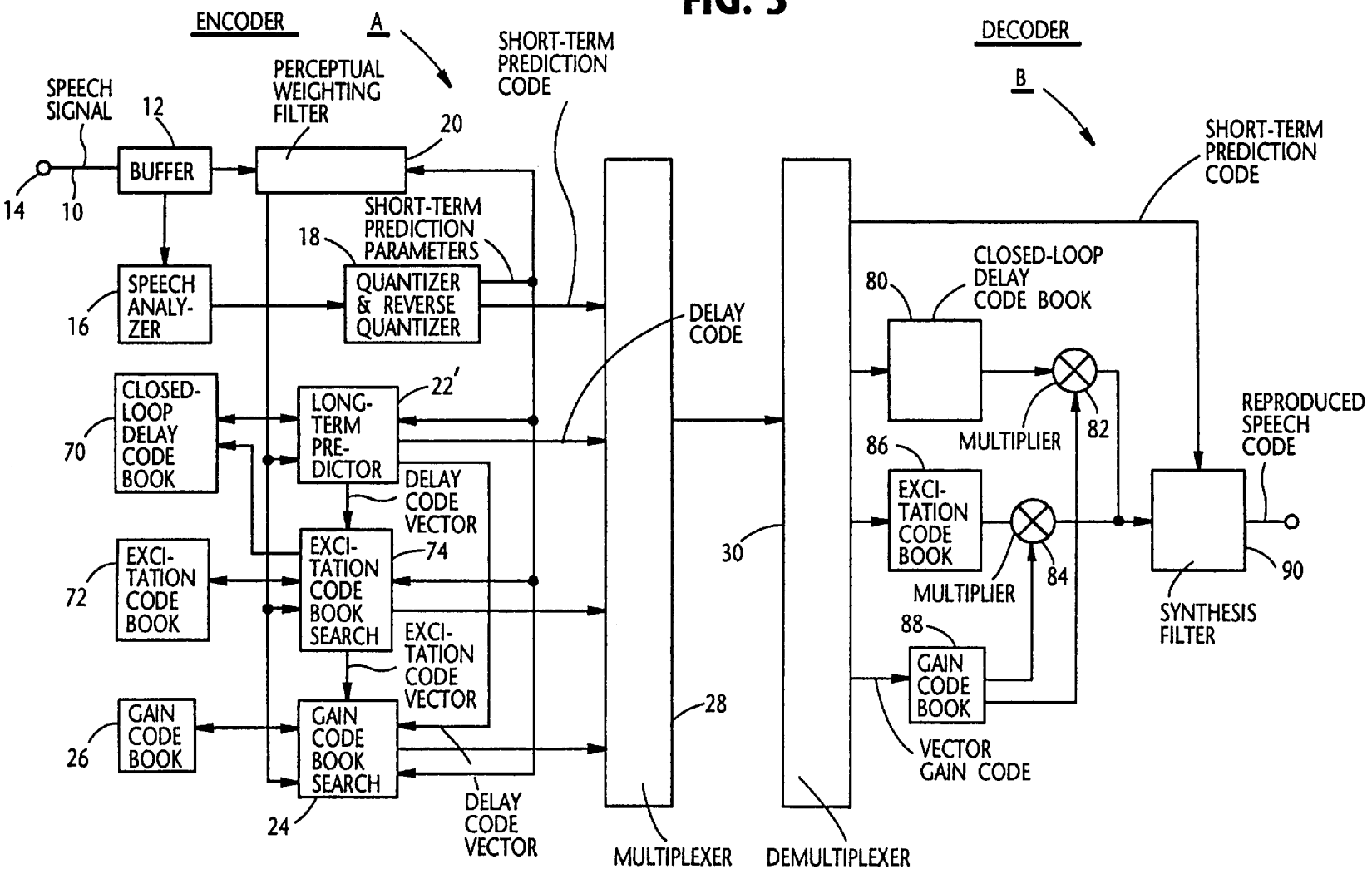
FIG. 3 is a block diagram showing a second, fourth, and sixth embodiment of the present invention.
Figure 4:
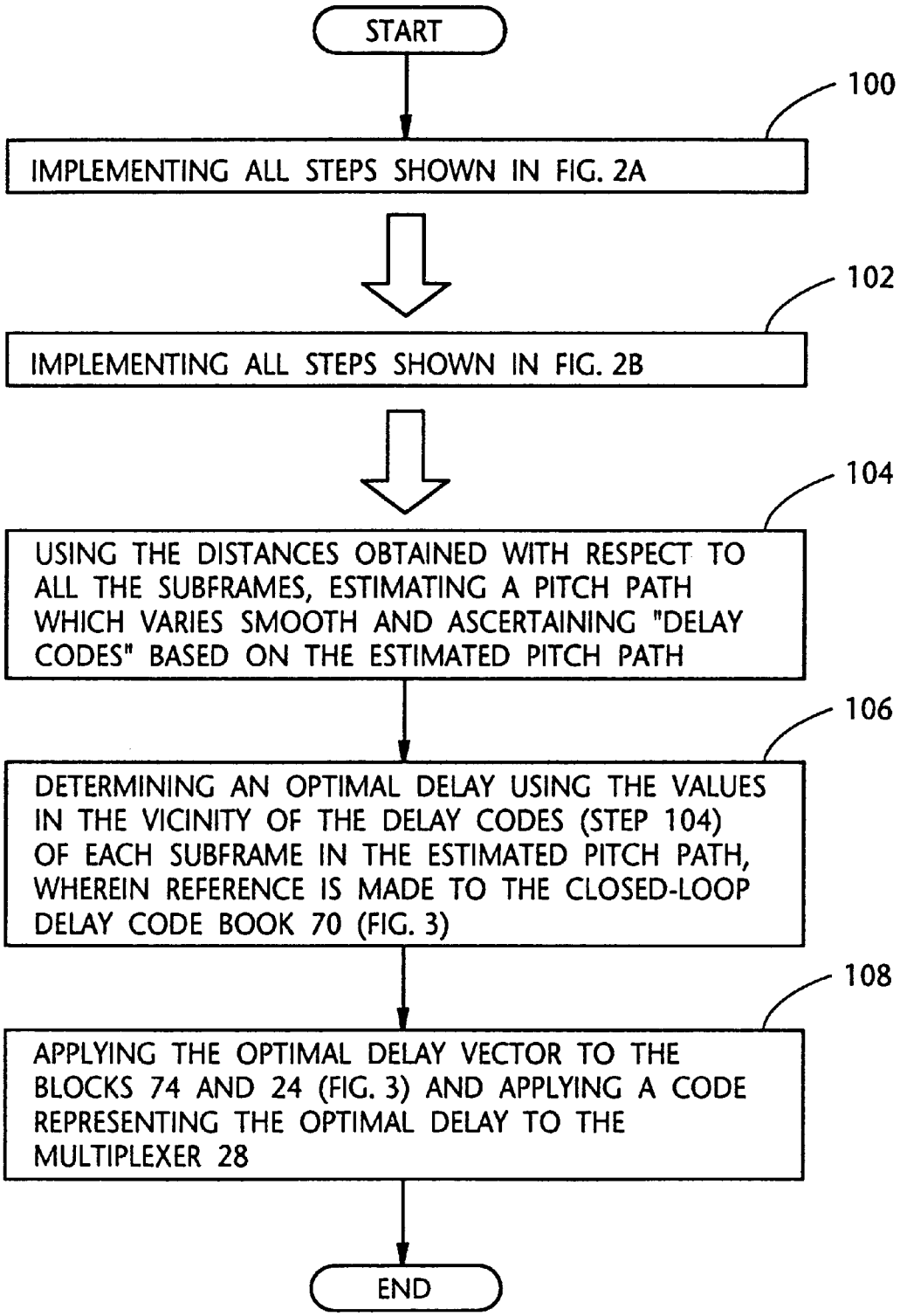
FIG. 4 is a flow chart which includes steps which characterize the operations of a long-term predictor of FIG. 3.

FIG. 3 is a block diagram showing the second embodiment of the present invention, while FIG. 4 is a flow chart illustrating steps for implementing a long-term predictor of FIG. 3.

An encoder A of FIG. 3 differs from the counterpart of FIG. 1 in that the former encoder further includes a closed-loop delay (adaptive) code book 70, an excitation code book 72, and an excitation source searcher 74. It is to be noted that a long-term predictor (depicted by 22') of FIG. 3 operates in a manner slightly different from the predictor 22 of FIG. 1 as will be discussed later. Other than this, the arrangement of FIG. 3 is essentially identical with that of FIG. 1.

In FIG. 3, the long-term predictor 22' applies delay code vectors to the excitation code book searcher 74 and the gain code book searcher 24. The delay code book 70 stores past (previous) excitation codes which has been applied thereto from the excitation code book searcher 74. The excitation code book 72 stores excitation code vectors each of which has a subframe length and represents a long-term prediction residual and which is accessed by the excitation code book searcher 74. On the other hand, in the second embodiment, the gain code book search 24 determines two gains (one is a delay vector gain and the other is an excitation vector gain) and applies two different codes of the delay and excitation vectors to the multiplexer 28.

A decoder B of FIG. 3 includes a plurality of blocks depicted by reference numerals 80, 82, 84, 86, 88, and 90. The decoder B is of conventional type and hence further descriptions thereof are omitted for the sake of simplifying the disclosure.

The operations of the long-term predictor 22' of FIG. 3 are described with reference to FIG. 4.

In FIG. 4, blocks 100 and 102 indicate that the steps of FIG. 2A and 2B are first implemented in the second embodiment. Step 104 corresponds to step 60 of FIG. 2C and accordingly the descriptions thereof are omitted merely for brevity.

At step 106, an optimal delay is determined using the values in the vicinity of the delay codes (obtained at step 104) of each subframe in the estimated pitch path. In this case, reference is made to the closed-loop delay code book 70 (FIG. 3). Although the operations at step 106 are known in the art, combining them with the first embodiment exhibits a good result in determining an optimal delay.

Finally, at step 108, the optimal delay vector is applied to the blocks 74 and 24 (FIG. 3). Further, a code representing the optimal delay is sent to the multiplexer 28.

Third Embodiment

Figure 5:
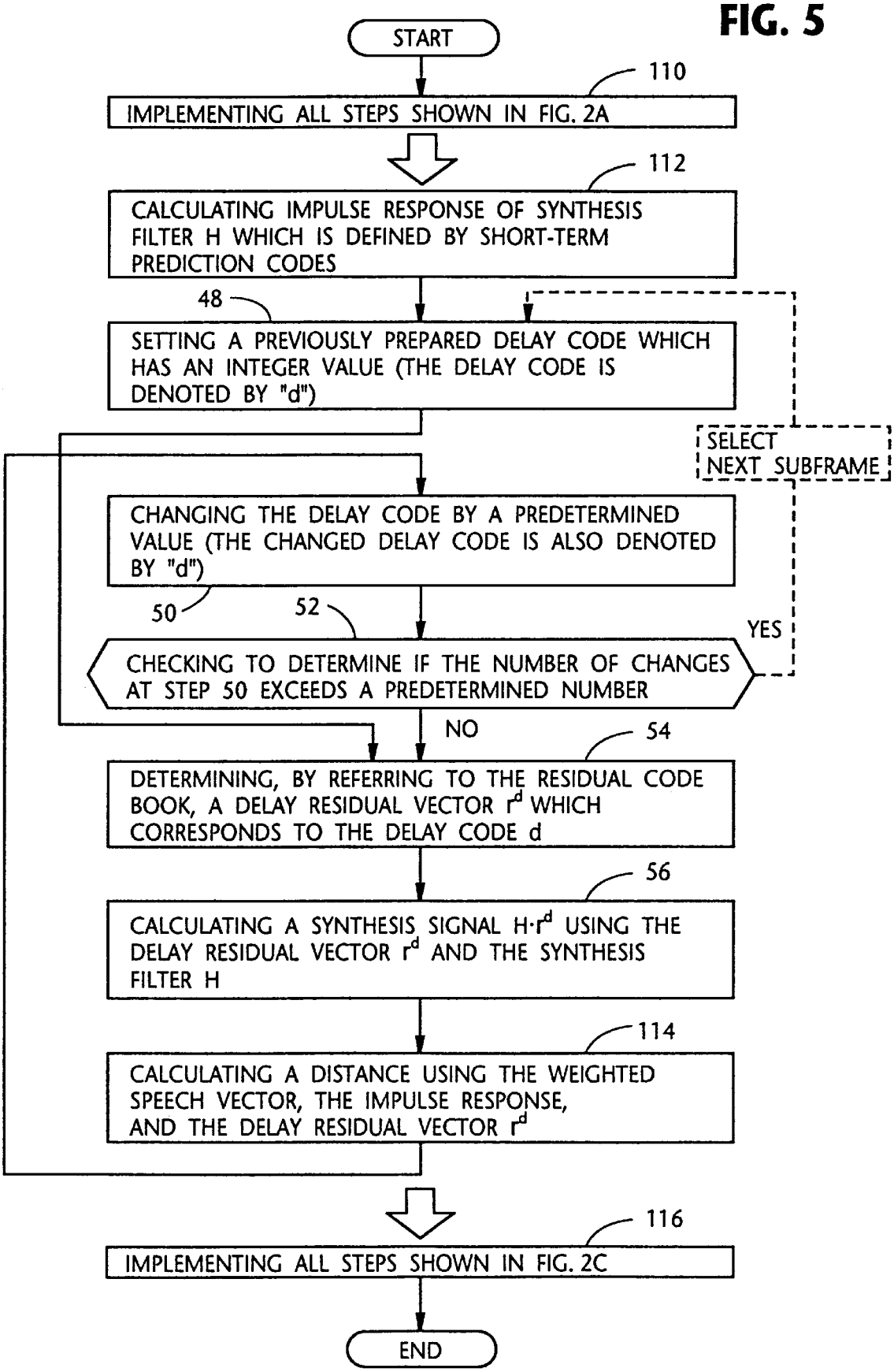
FIG. 5 is a flow chart which characterizes a third embodiment.

The third embodiment is a variant of the first embodiment and is discussed with reference to a flow chart shown in FIG. 5. As shown in FIG. 5, all steps shown in FIG. 2A are first implemented as indicated at a block 110. Thereafter, at step 112, an impulse response of the synthesis filter H which is defined by short-term prediction codes (viz., parameters) is calculated. The following five steps 48, 50, 52, 54 and 56 are respectively identical to steps of FIG. 2B labelled the same number, and hence the descriptions thereof are not given here merely for simplifying the disclosure. At step 114, a distance (or correlation) is calculated using the perceptively weighted speech vector, the impulse response, and the delay residual vector $f^d$. More specifically, $d^2$ is determined as follows:

$$d^2=CC^2/AC$$

where

CC: cross-correlation value; and

AC: auto-correlation value

After having determined the distances of all the subframe of one frame, the routine goes to a block 116 wherein all steps shown in FIG. 2C are implemented.

Although the operations at steps 112 and 114 are known in the art, combining them with the second embodiment exhibits a good result in determining an optimal delay.

Fourth Embodiment

The fourth embodiment is a variant of the third embodiment and is described with reference to a flow chart shown in FIGS. 6A and 6B.

Figure 6A:
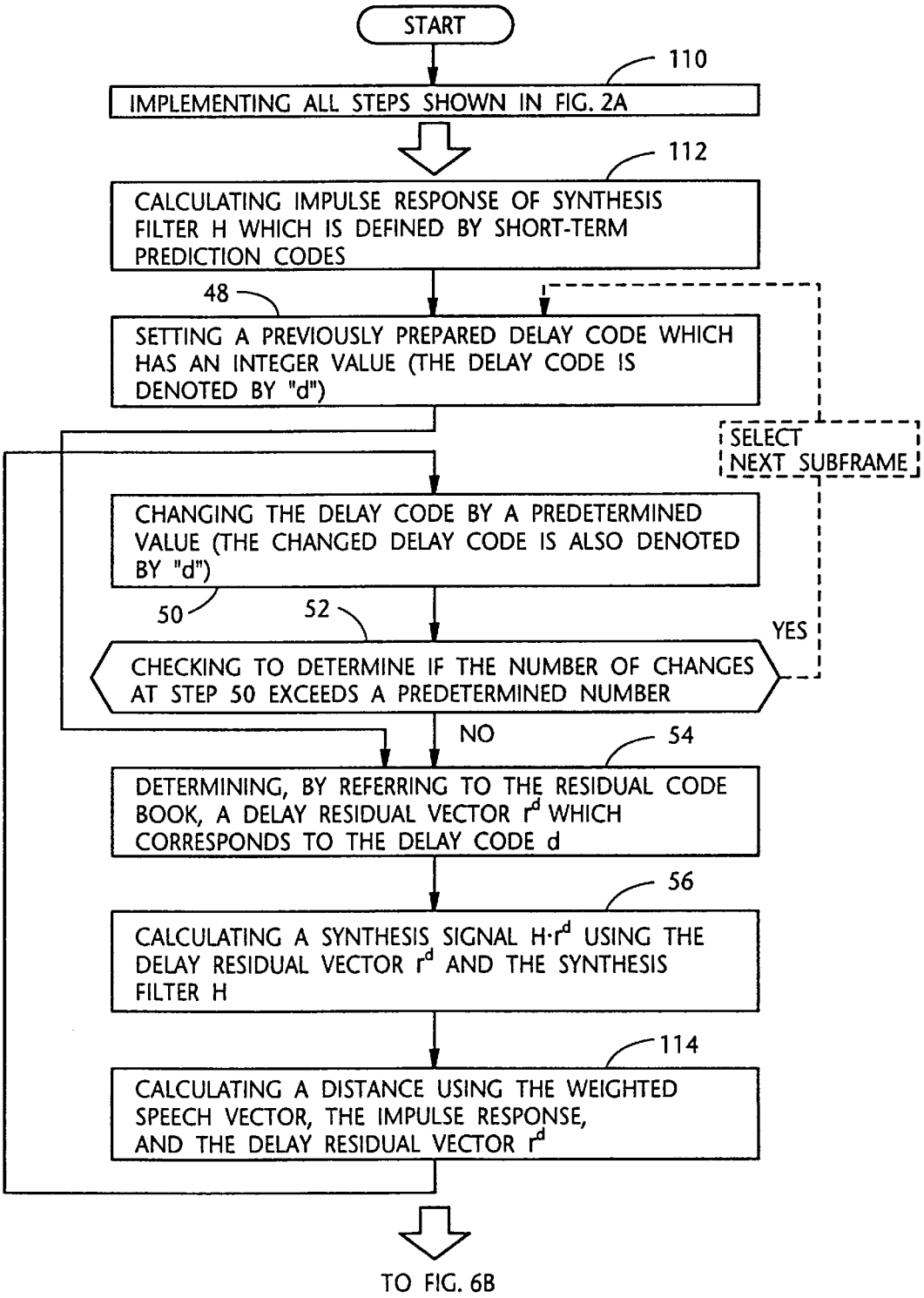
FIGS. 6A and 6B are flow charts which characterize a fourth embodiment.
Figure 6B:
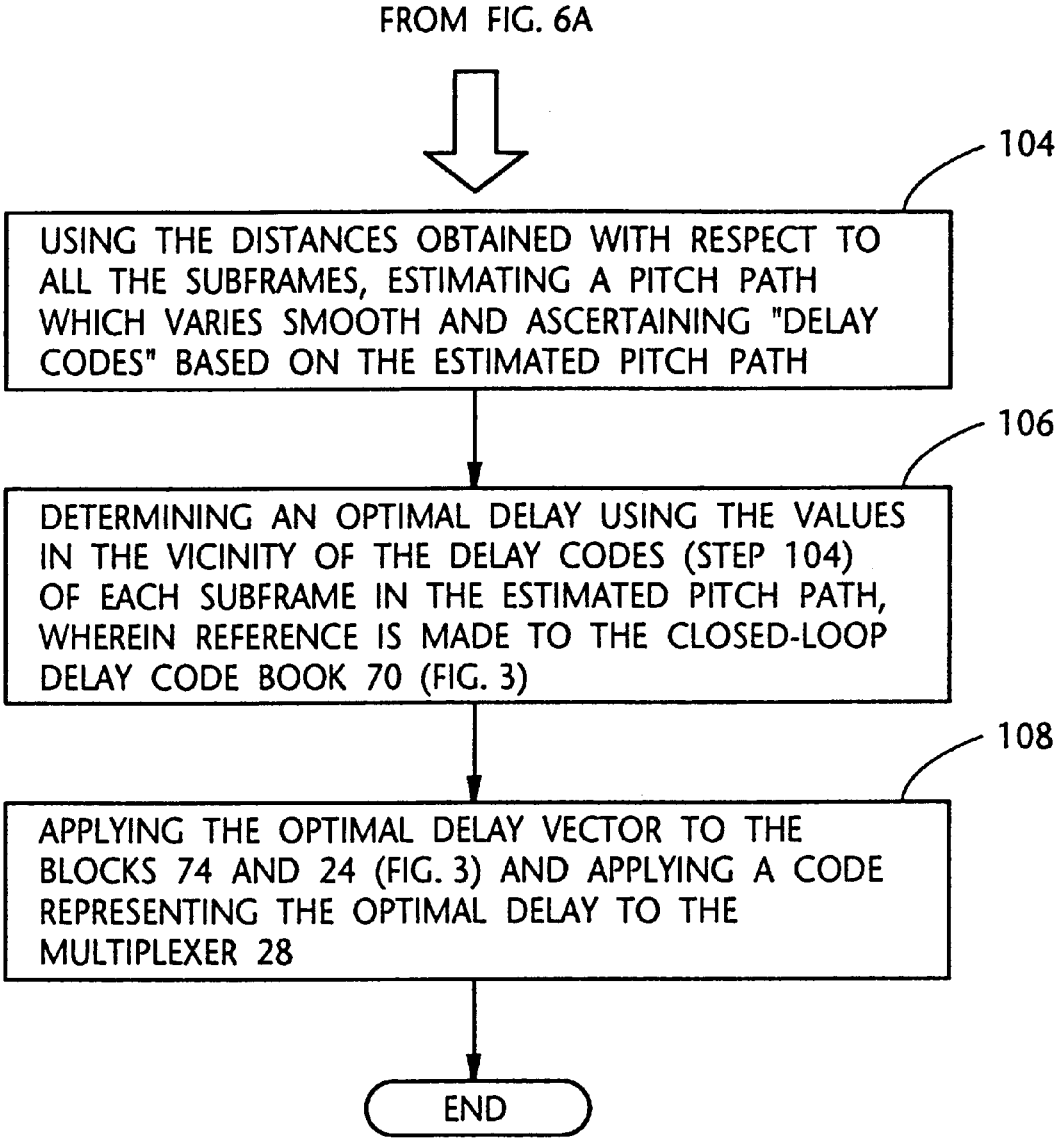

FIG. 6A shows a plurality of operation steps which have already been referred to in connection with FIG. 5 (only the block 116 of FIG. 5 is not shown in FIG. 6A) and thus, the further descriptions of FIG. 6A are omitted for brevity. On the other hand, FIG. 6B shows steps 104, 106, and 108 which also have been discussed with reference to FIG. 4 and hence no discussion thereof is given.

Fifth Embodiment

Figure 7:
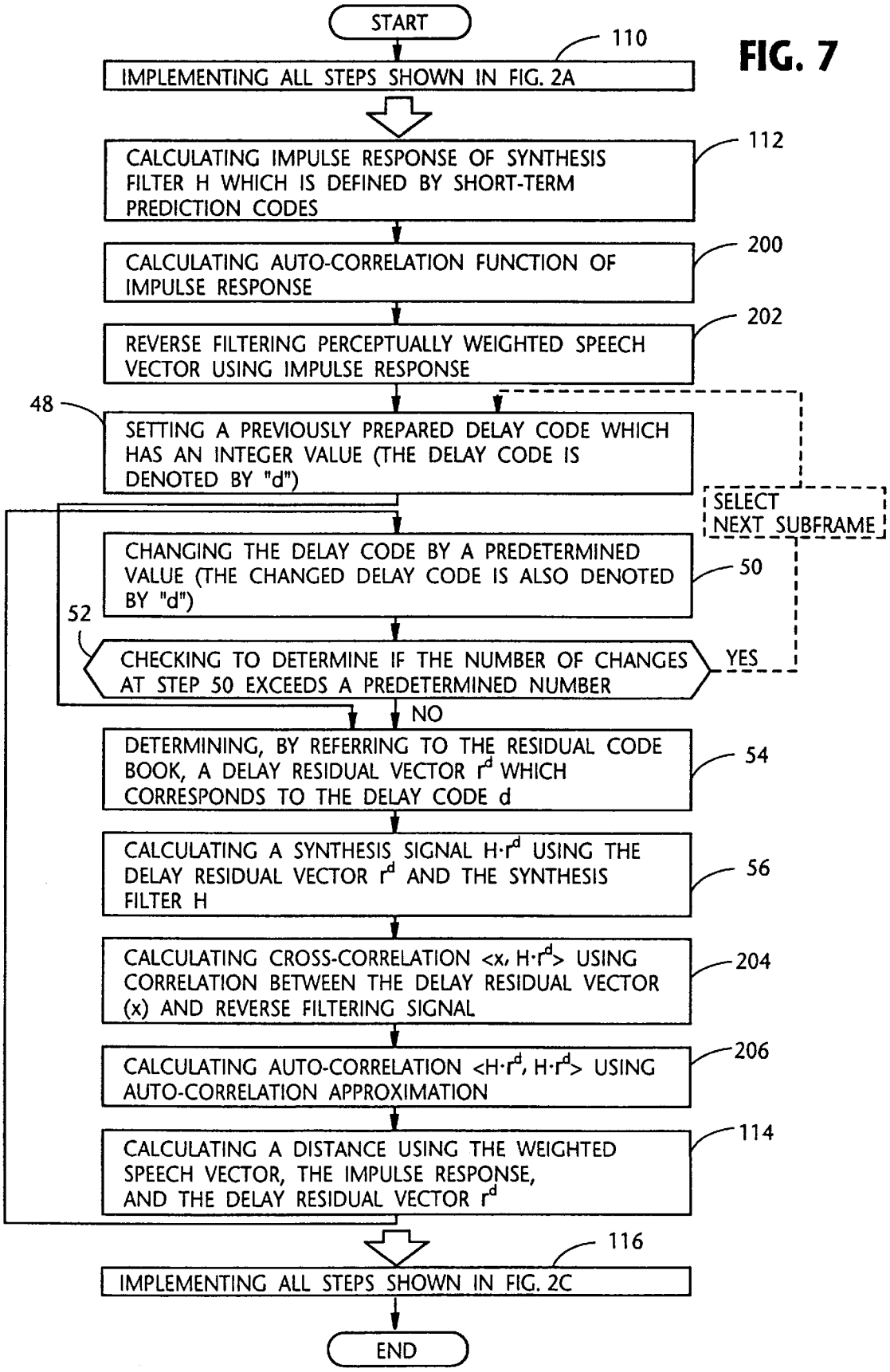
FIG. 7 is a flow chart which characterizes a fifth embodiment.

The fifth embodiment is a second variant of the first embodiment and is discussed with reference to a flow chart shown in FIG. 7. As shown in FIG. 7, four steps 200, 202, 204 and 206 are added to the flow chart of FIG. 5 and other than this, the FIG. 7 is identical with FIG. 5. Therefore, only the newly added steps are described hereinbelow.

At step 200, an auto-correlation function of the impulse response (determined at step 112) is calculated. Subsequently, at step 202, the perceptually weighted speech vector is reverse filtered using the impulse response. On the other hand, at step 204, cross-correlation $<x, H\cdot r^d>$ is calculated using correlation between the delay residual vector (x) and a revere filtering signal. Following this, at step 206, auto-correlation $<H\cdot r^d, H\cdot r^d>$ is calculated using auto-correlation approximation.

Although the operations at steps 200, 202, 204 and 206 are known in the art, combining them with the second first embodiment exhibits a good result in determining an optimal delay.

Sixth Embodiment

The sixth embodiment is a second variant of the second embodiment and is described with reference to a flow chart shown in FIGS. 8A and 8B.

Figure 8A:
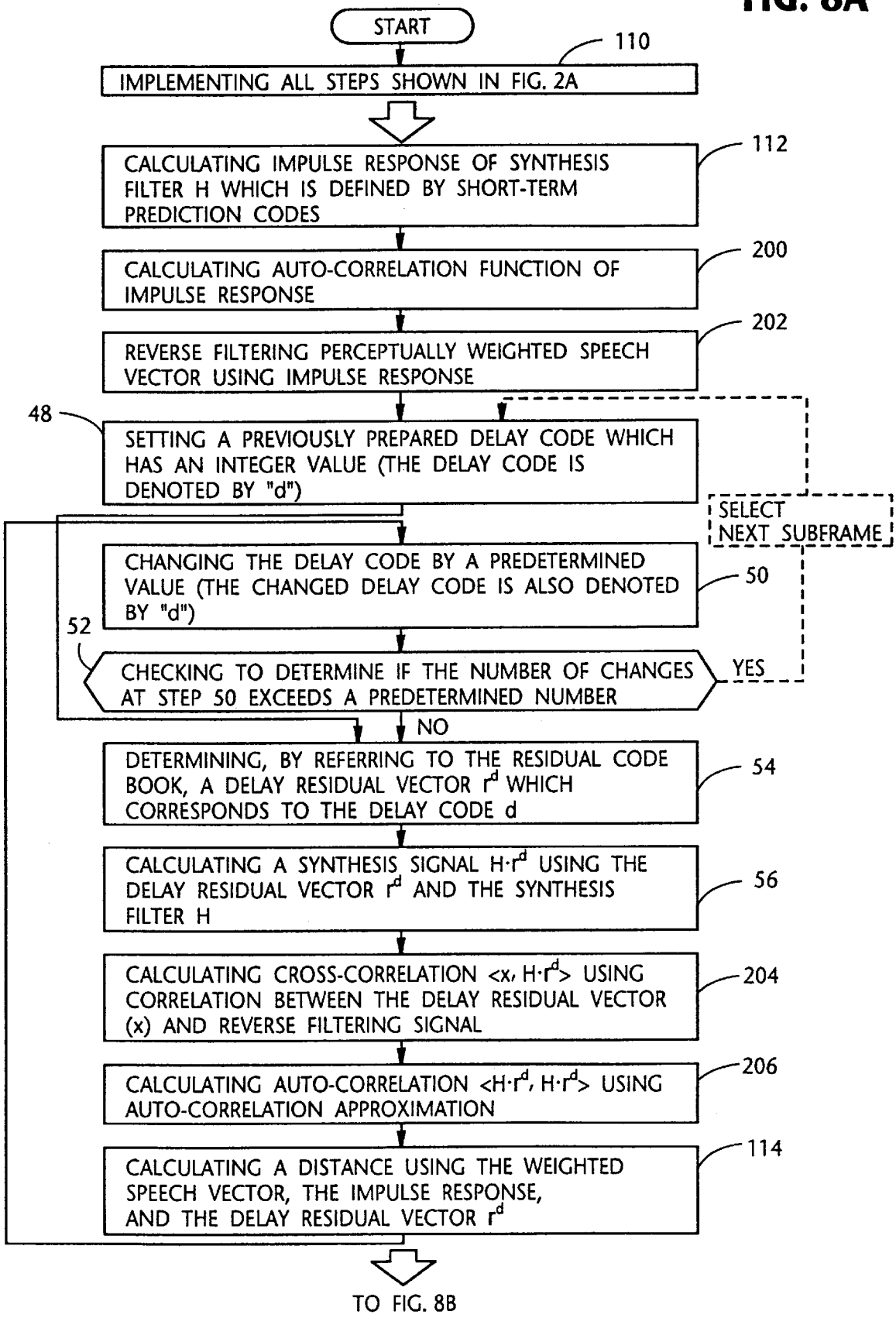
FIGS. 8A and 8B are flow charts which characterize a sixth embodiment.
Figure 8B:
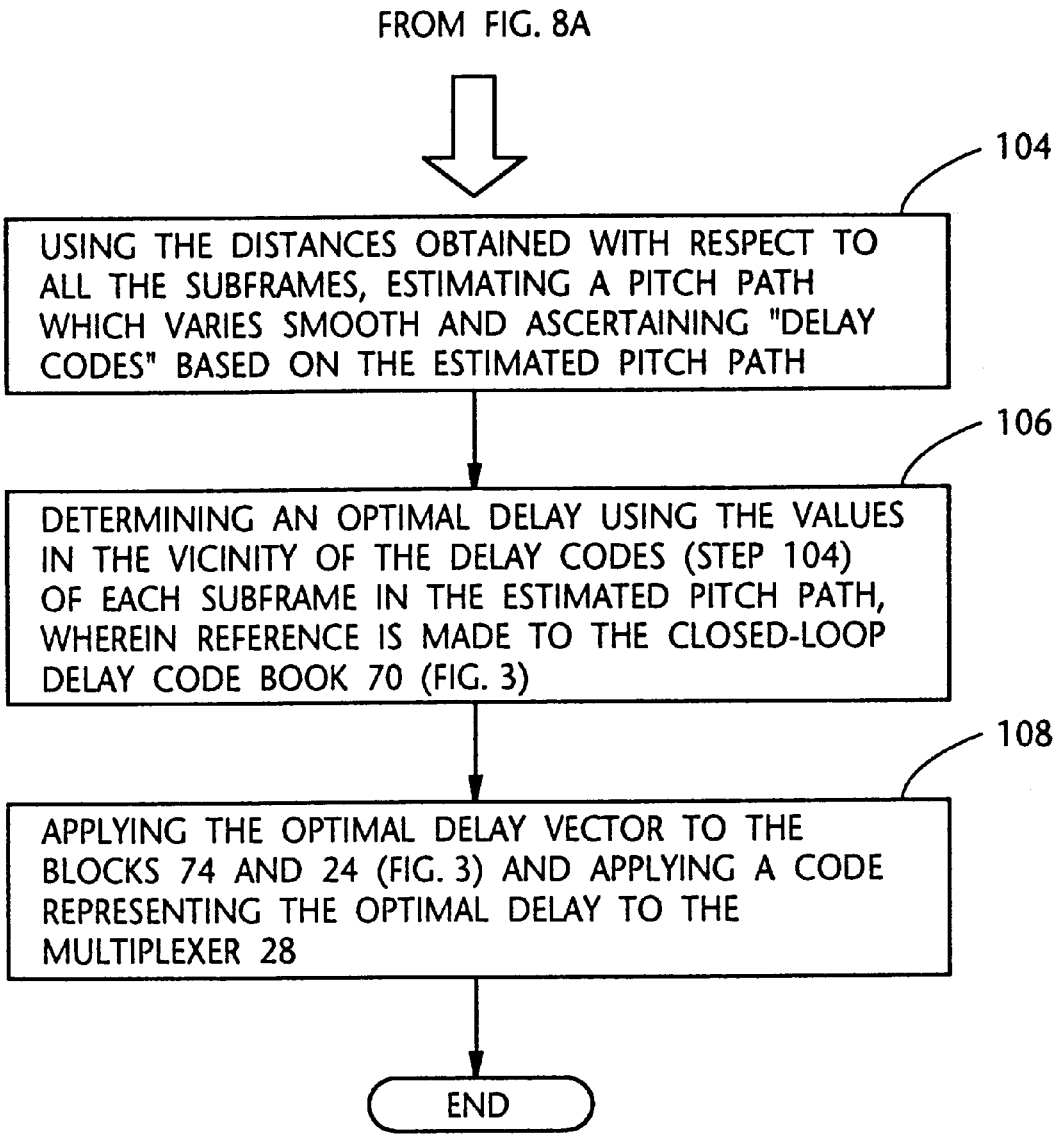

FIG. 8A shows a plurality of operation steps which have already been referred to in connection with FIG. 7 (only the block 116 of FIG. 7 is not shown in FIG. 8A) and thus, the further descriptions of FIG. 8A are omitted for brevity. On the other hand, FIG. 8B shows steps 104, 106, and 109 which also have been discussed with reference to FIG. 6B and hence no discussion thereof is given.

It will be understood that the above disclosure is representative of only six possible embodiments of the present invention and that the concept on which the invention is based is not specifically limited thereto.

What is claimed is:

1. A method of encoding a speech signal using a long-term predictor, wherein the speech signal is partitioned into a plurality of frames each of which is further divided into a plurality of subframes, said method comprising the steps of:

(a) receiving weighted speech vectors generated by perceptually weighing the speech signal, and receiving short-term prediction parameters generated using the speech signal;

(b) determining residual signals with respect to all the subframes within one frame by reverse filtering the weighted speech vectors;

(c) storing the residual signals in a residual code book;

(d) setting a previously prepared delay code;

(e) determining, by referring to the residual code book, a delay residual vector which corresponds to the prepared delay code;

(f) calculating a synthesis signal using the delay residual vector and a synthesis filter;

(g) calculating a distance between the synthesis signal and the corresponding weighted speech vector; and (h) repeating steps (d)–(g) by changing the prepared delay code, by a predetermined value until a number of changes of the delay code reaches a predetermined number.

2. The method as claimed in claim 1, further comprising the steps of:

(i) estimating a pitch path using distances between the synthesis signal and the corresponding weighted speech vector with respect to all the subframes; and (j) ascertaining delay codes and delay code vectors based on the pitch path.

3. The method as claimed in claim 1, further comprising the steps of:

(i) estimating a pitch path using the distances between the synthesis signal and the corresponding weighted speech vector with respect to all the subframes;

(j) ascertaining delay codes and delay code vectors based on the pitch path; and (k) determining an optimal delay using values in the vicinity of the delay codes of each subframe in the pitch path, wherein reference is made to a closed-loop delay code book.

4. The method as claimed in claim 1, further comprising between steps (c) and (d);

(i) calculating an impulse response of the synthesis filter which is defined by the short-term prediction parameters, wherein the distance in step (g) is calculated using the weighted speech vector, the impulse response, and the delay residual vector.

5. The method as claimed in claim 4, further comprising after step (h):

(j) estimating a pitch path using the distances obtained at step (g) with respect to all the subframes; and (k) ascertaining delay codes and delay code vectors based on the pitch path.

6. The method as claimed in claim 4, further comprising after step (h);

(j) estimating a pitch path using the distances obtained at step (g) with respect to all the subframes;

(k) ascertaining delay codes and delay code vectors based on the pitch path; and (l) determining an optimal delay using values in the vicinity of the delay codes of each subframe in the pitch path, wherein reference is made to a closed-loop delay code book.

7. The method as claimed in claim 4, further comprising between step (i) and (d):

(i) calculating an auto-correlation function of the impulse response; and (j) reverse filtering the weighted speech vector using the impulse response, and further comprising between steps (f) and (g):

(k) calculating cross-correlation between the delay residual vector and a reverse filtering signal; and (l) calculating auto-correlation using auto-correlation approximation.

8. The method as claimed in claim 7, further comprising after step (h):

(m) estimating a pitch path using the distances obtained at step (g) with respect to all the subframe; and (n) ascertaining delay code and delay code vectors based on the pitch path.

9. The method as claimed in claim 7, further comprising after step (h):

(m) estimating a pitch path using the distances obtained at step (g) with respect to all the subframe:

(n) ascertaining delay codes and delay code vectors based on the pitch path; and (o) determining an optimal delay using values in the vicinity of the delay codes of each subframe in the pitch path, wherein references is made to a closed-loop delay code book.

10. A speech signal encoder, comprising:

a speech analyzer for determining short-term prediction codes at a predetermined time interval, indicative of frequency characteristics of a speech signal;

a reverse filter for calculating residual signals of a first synthesis filter, said residual signals being defined by said short-term prediction codes;

a residual code book for storing past residual signals;

means for performing delay trials using a plurality of delay codes, each of which represents pitch correlation of said speech signal and is a predetermined number;

a vector generator for generating, using said residual code book, delay residual vectors each of which corresponds to one of said delay codes;

a filter for generating a second synthesis signal using a second synthesis filter which receives said delay residual vectors and which is defined by said short-term prediction codes;

distance calculating means for calculating a distance between said speech signal and said second synthesis signal; and a pitch path estimator for estimating a pitch path which varies smoothly and for determining second delay codes using said pitch path.

11. A speech signal encoder as claimed in claim 10, further comprising:

an adaptive code book for storing past excitation signals; and means for determining, by referring to said adaptive code book, an optimal delay code based on said second delay codes determined using said pitch path estimator.

12. A speech signal encoder, comprising:

a speech analyzer for determining short-term prediction codes indicative of frequency characteristics of a speech signal at a predetermined time interval;

means for calculating an impulse response of a synthesis filter using said short-term prediction codes;

a reverse filter for calculating residual signals of said synthesis filter, said residual signals being defined by said short-term prediction codes;

a residual code book for storing past residual signals;

means for performing delay trials using a plurality of delay codes, each of which represents pitch correlation of said speed signal and is a predetermined number;

a vector generator for generating, using said residual code book, delay residual vectors each of which corresponds to one of said delay codes;

distance calculating means for calculating a distance using said speech signal, said impulse response and said delay residual vector; and a pitch path estimator for estimating a pitch path which varies smoothly and for determining second delay codes using said pitch path.

13. A speech signal encoder as claimed in claim 12, further comprising:

an adaptive code book for storing past excitation signals; and means for determining, by referring to said adaptive code book, an optimal delay code based on said second delay codes determined using said pitch path estimator.

14. A speech signal encoder as claimed in claim 12, wherein said distance calculating means determines said distance using one or both of auto-correlation and cross-correlation, said auto-correlation being determined using two auto-correlation functions of said impulse response and said delay residual vector, and said cross-correlation respresenting correlation between a reverse filtering signal and said delay residual vector, said reverse filtering signal being determined by said speech signal and said impulse response.

15. A speech signal encoder as claimed in claim 13, wherein said distance calculating means determines said distance using one or both of auto-correlation and cross-correlation, said auto-correlation being determined using two auto-correlation functions of said impulse response and said delay residual vector, and said cross-correlation representing correlation between a reverse filtering signal and said delay residual vector, said reverse filtering signal being determined by said speech signal and said impulse response.

* * * * *

UNITED STATES PATENT AND TRADEMARK OFFICE

CERTIFICATE OF CORRECTION

PATENT NO. : 5,924,063
DATED : July 13, 1999
INVENTOR(S) : Keiichi FUNAKI and Kazunori OZAWA It is certified that error appears in the above-identified patent and that said Letters Patent is hereby corrected as shown below:

| | | |
|---|---|---|
| Column 1, | line 54, | delete "sinal" and insert --signal--. |
| Column 2, | line 52, | delete "entirg" and insert --entire--. |
| Column 8, | line 28, | delete "revere" and insert --reverse--. |
| Column 8, | line 43, | delete "109" and insert --108--. |

Signed and Sealed this

Twenty-fifth Day of April, 2000

*Attest:*

*Attesting Officer*

Q. TODD DICKINSON

*Director of Patents and Trademarks*